United States Patent [19]

Bodine

[11] Patent Number: 4,836,299

[45] Date of Patent: Jun. 6, 1989

[54] SONIC METHOD AND APPARATUS FOR INSTALLING MONITOR WELLS FOR THE SURVEILLANCE AND CONTROL OF EARTH CONTAMINATION

[76] Inventor: Albert G. Bodine, 7877 Woodley Ave., Van Nuys, Calif. 91406

[21] Appl. No.: 110,194

[22] Filed: Oct. 19, 1987

[51] Int. Cl.[4] ..... E21B 7/24

[52] U.S. Cl. ..... 175/22; 175/171; 175/249; 166/177

[58] Field of Search ..... 173/1, 49, 139; 175/19, 175/20, 22, 23, 56, 171, 135, 249, 320; 166/177; 405/232, 243, 242, 248

[56] References Cited

U.S. PATENT DOCUMENTS

| | | | |
|---|---|---|---|
| 790,910 | 5/1905 | McClintock | 175/23 X |
| 3,049,185 | 8/1962 | Herbold | 166/177 X |
| 3,139,945 | 7/1964 | Del Re et al. | 175/135 X |
| 3,261,412 | 7/1966 | Lob | 175/22 |
| 3,624,760 | 11/1971 | Bodine | 175/171 X |
| 3,932,999 | 1/1976 | Todd | 173/139 X |
| 4,286,651 | 9/1981 | Steiger et al. | 175/22 X |

*Primary Examiner*—Frank T. Yost

*Assistant Examiner*—James L. Wolfe

*Attorney, Agent, or Firm*—Edward A. Sokolski

[57] ABSTRACT

A well casing of an elastic metal material is placed in concentric relationship with a casing of an inert material such as a suitable plastic. A penetrating cap piece is placed on the bottom end of the metallic casing. The two concentric casings are then driven into the earth in an area to be monitored for contamination, such driving action being achieved by a sonic oscillator which is attached to the top end of the metallic casing. Preferably, the sonic energy is provided at a frequency such as to effect resonant standing wave vibration of the metallic casing. Further, water may be injected down the casing so as to lubricate the earthen structure immediately below the cap to accelerate the penetration of the casing. When the casings have been driven to the desired depth, the metallic casing is withdrawn by lifting up thereon while continuing to apply sonic energy, leaving the casing of inert material in place such that earth samples can be periodically withdrawn from the well thus formed. A core sampling for analysis can also be withdrawn within one of the casings.

11 Claims, 5 Drawing Sheets

SONIC METHOD AND APPARATUS FOR INSTALLING MONITOR WELLS FOR THE SURVEILLANCE AND CONTROL OF EARTH CONTAMINATION

This invention relates to the monitoring of the earth for contaminants and more particularly for a sonic method and apparatus for installing monitor wells for use in achieving this end result.

In regions of soil, particularly around chemical plants, food processing plants, cattle feed lots, oil refineries, atomic disposal sites, etc., undesirable contamination conditions can occur which can result in pollution. To become aware of such pollution conditions so that the necessary remedial action can be taken, the condition of the soil should be monitored for periodic analysis. This end result is often achieved by installing monitor wells in the earthen area to be monitored to enable the withdrawal of samples of earthen material at various depths below the surface. In the installation of such monitor wells, it is desirable to have the well casing in tight sealing engagement with the surrounding earth so that the earthen samples taken from the well can be positively identified as to the level of the earth from which they have been taken. Further, it is important that the well casing be fabricated of an inert material such as for example, polyethylene such that such casing will not introduce contaminants into fluids which may enter the casting.

The system and method of the present invention provides a highly efficient technique for installing monitor wells in the ground which have the desirable properties indicated above. This end result is achieved by placing a pair of casings in concentric relationship to each other, one of these casings being of an inert material such as of a suitable plastic while the other of the casings is of an elastic metal such as steel. A metal cap or bit member is installed on the bottom end of the metal casing and the casing is driven into the ground by means of sonic energy generated by means of a sonic oscillator which is coupled to the top end of the metal casing. This sonic energy preferably is applied at a frequency such as to effect resonant standing wave vibration of the metal casing. Small amounts of water may be fed through the center of the innermost casing to the bottom of the well to lubricate the earthen structure immediately below the drive member to accelerate penetration into the soil. A lubricating layer of material such as Teflon may be installed between the opposing walls of the inner and outer casing and/or a suitable clearance may be provided therebetween.

After the casings have been driven to the desired depth in the earth, the oscillator casing is lifted upwardly while sonic energy continues to be applied to the metal casing to withdraw such metal casing from the earth leaving the casing of inert material (plastic) insitu. In certain embodiments of the invention, a sample core of earthen material is withdrawn from the earth within the metal casing for analysis. Samplings of the earthen material at the bottom of the well can be periodically taken by lowering a sampling tool to the bottom of the well through the installed casing.

It is therefore an object of this invention to facilitate the sampling of earthen material at various depth levels for contaminant analysis.

It is a further object of this invention to provide a sonic method and apparatus for efficiently installing a monitor well for use in sampling earthen material for contaminants at various depth levels.

It is still a further object of this invention to provide a sonic method and apparatus for installing a casing of inert material in concentric relationship with an elastic metal casing in the ground to form a well, the metal casing then being sonically removed from the well to leave the casing of inert material insitu.

Other objects of the invention will become apparent as the description proceeds in connection with the accompanying drawings of which:

Figure 1:
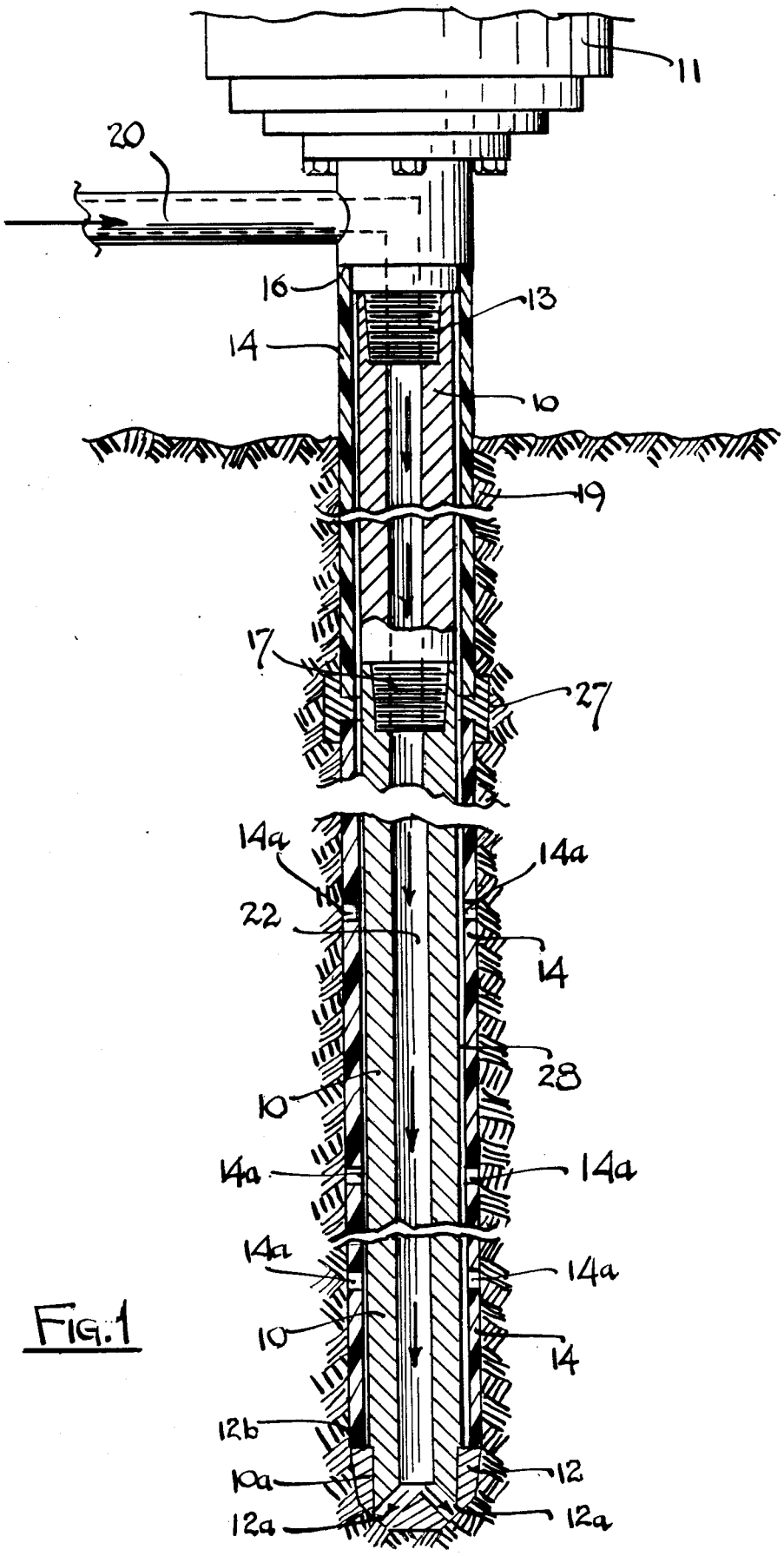
FIG. 1 is and elevational view in cross section of a first embodiment of the invention.

Referring now to FIG. 1, a first embodiment of the invention is illustrated. Metallic casing member 10 is attached to the housing of orbiting mass oscillator 11 by means of threaded fitting 13 which extends from the bottom end of the housing. Successive sections of casing 10 are attached to each other by means of similar threaded fittings 17. Metal casing 10 may be fabricated of a suitable elastic material such as steel. Loosely attached to the bottom end of metal casing 10 on dowel nect **10*a* is an end cap 12 which provides a penetrating head and which has apertures 12*a* formed therein forming liquid ejection nozzles. An inlet pipe 20 is provided for feeding water into casing 10**.

Casing 14 which is of an inert material such as a suitable plastic such as polyethylene is installed in external concentricity with metal casing 10. Casing 14 is retained between flange 16 of housing 11 at its top end and the top surface **12*b* of cap member 12 at its bottom end. A small clearance space 28 is provided between casings 14 and 10 to afford a loose fitting engagement between the two casing members. Threaded couplers 27 are provided to join successive sections of casing 14 to each other. A plurality of perforation 14*a* are provided in casing 14**.

Oscillator 11 which may be of the orbiting mass type such as described in my U.S. Pat. No. 4,645,017 is rotatably driven to generate vibratory energy at a sonic frequency. This energy is coupled principally to elastic casing 10 to drive this casing and along with it casing 14 into the earth 19 with cap 12 acting as a penetrating head. Oscillator 11 is preferably driven at a frequency such as to effect resonant elastic standing wave vibration of the casings. A small amount of water may be injected into casing 10 through inlet pipe 20 and out through nozzles **12*a* to the earthen material immediately below cap 12 to lubricate the earthen material and facilitate the penetration. Sonic cavitation in the waer layer adjacent cap 12 aids fluidization of the earthen material. When the casing members have been driven to the desired depth, sonic vibration is continued at low power for several minutes causing the surrounding earthen material to vibrate and settle tightly against the outside surface of outer casing 14. High level resonant vibration of inner casing 10 is then resumed while upward lifting force is exerted on the housing of oscillator 11 thereby extracting inner casing 10 leaving outer casing 14 and cap member 12 in place in the ground, the cap being only loosely guided on the end of casing 10 by means of dowel neck 10***a* formed at the end of casing 10.

Figure 2:
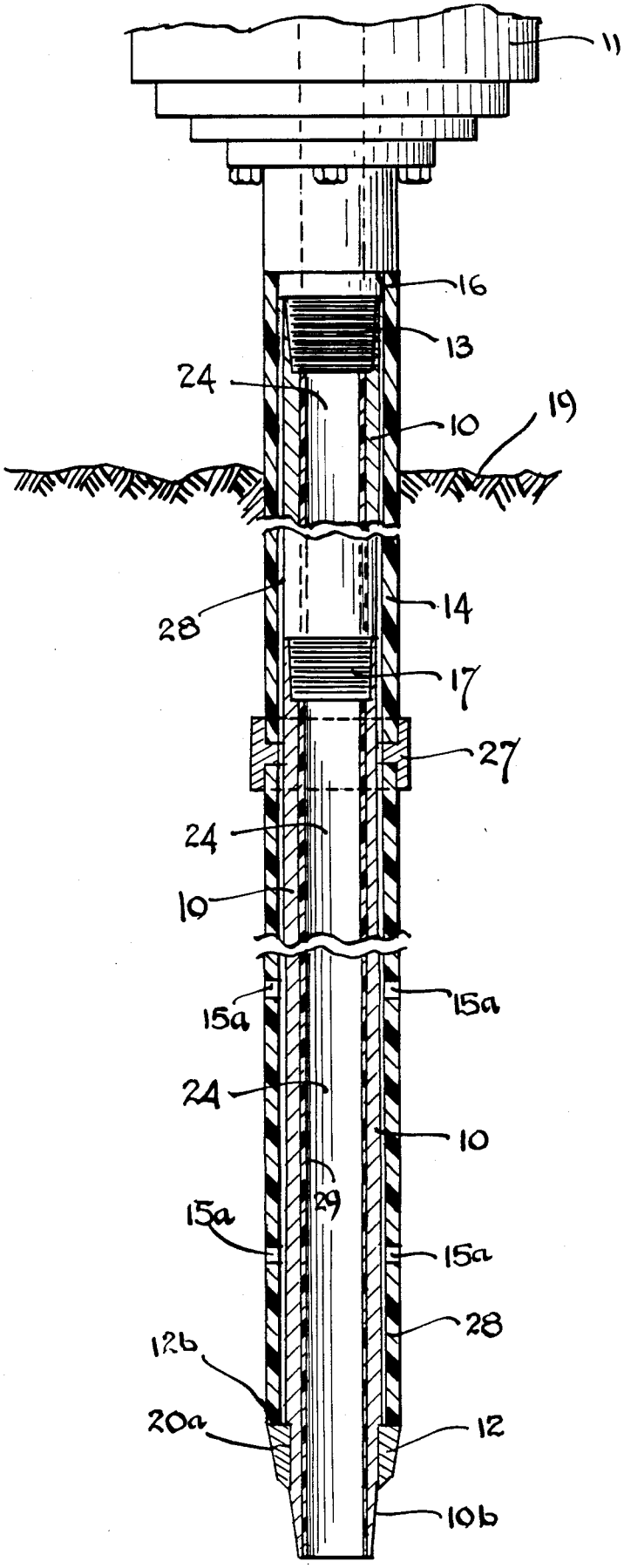
FIG. 2 is and elevational view in cross section of a second embodiment of the invention.

Referring now to FIG. 2, a second embodiment of the invention is illustrated. This second embodiment is generally similar to the first and employs an oscillator 11 of the same type as for the first embodiment and with an outer casing of a suitable inert material such as polyethylene and an inner casing 10 of an elastic metal such as steel. As for the first embodiment, a cap piece 12 is loosely fitted on dowel neck 10*a* near the bottom end of metal casing 10. The casing 10, however, has a thin wall tubular extension 10*b* which extends through the cap member beyond the dowel neck portion 10*a* of the casing. The inner wall of casing 10 has a coating 29 thereon of a low friction material such as Teflon. As for the previous embodiment, outer casing 14 is retained between flanges 16 and 12*b* with a small space 28 being provided between casings 10 and 14 to provide a loose fit therebetween.

As for the previous embodiment, oscillator 11 is driven at a frequency such as to effect resonant standing wave vibration of the casings to drive them into the earth 19 to a desired depth. The thin walled open ended tubular extension 10*b* of casing 10 facilitates the entry of a core of earthen material into the passage 24 formed within casing 10. When the casings have been driven to the desired depth, upward lifting force is provided on the casing of oscillator 11 while sonic vibration is being continued, thereby lifting casing member 10 out of the earth while leaving casing member 14 and member 12 in place. A core of earthen material is retained within passage 24 and removed along with casing 10. This sample core can be removed from casing 10 by means of a hydraulic piston, the Teflon coating 29 facilitating such removal for analysis.

Figure 3:
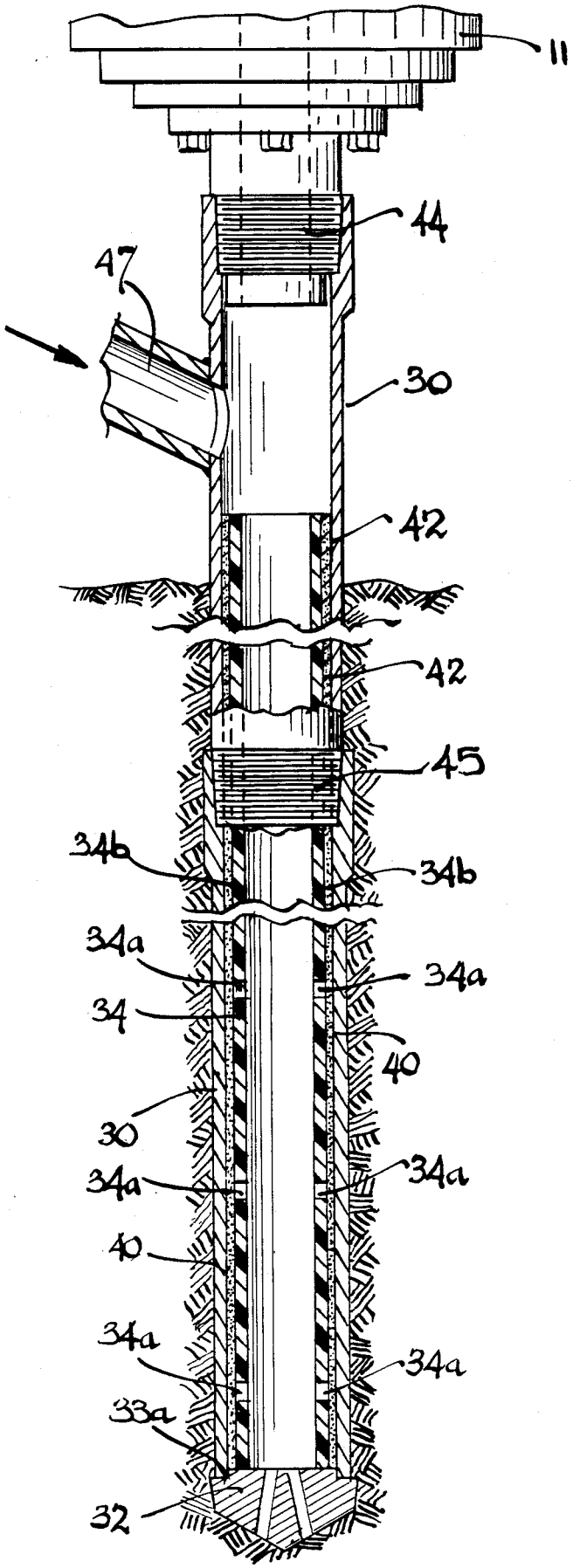
FIG. 3 is an elevational view in cross section of a third embodiment of the invention.

Referring now to FIG. 3, a further embodiment of the invention is illustrated. This embodiment is particularly useful in situations where there are fine silts in the earthen formation which might block up perforations in the casing to prevent the sampling of fluids through such perforations. In this embodiment, the metal casing member 30 is external to the plastic casing member 34. A cap member 32 is loosely joined to the bottom end of casing 30 with the bottom end of casing 30 abutting against shoulder 32*a* formed on bottom cap member 32. The bottom end of casing 34 abuts against the top edge of cap 32. The top end of casing 30 is joined to the housing of oscillator 11 by means of threaded fitting 44 with successive sections of casing 30 being joined together by threaded fittings 45. Spacing fingers 34*b* are provided along the wall of casing 34 to guide this casing in a centralized position within casing 30. An annulus of coarse sand 40 is introduced into the space between casings 30 and 34 through inlet pipe 47. To provide uniform distribution of the sand and good settling thereof in the annulus, it is desirable to sonically activate casing 30 by means of oscillator 11 while the sand is being fed into inlet pipe 47. Before placing the sand in place, the casings are sonically driven by means of oscillator 11 as in the previous embodiments at a frequency such as to effect resonant standing wave vibration of casing 30 to drive the casings into the ground to the desired depth.

Figure 3A:
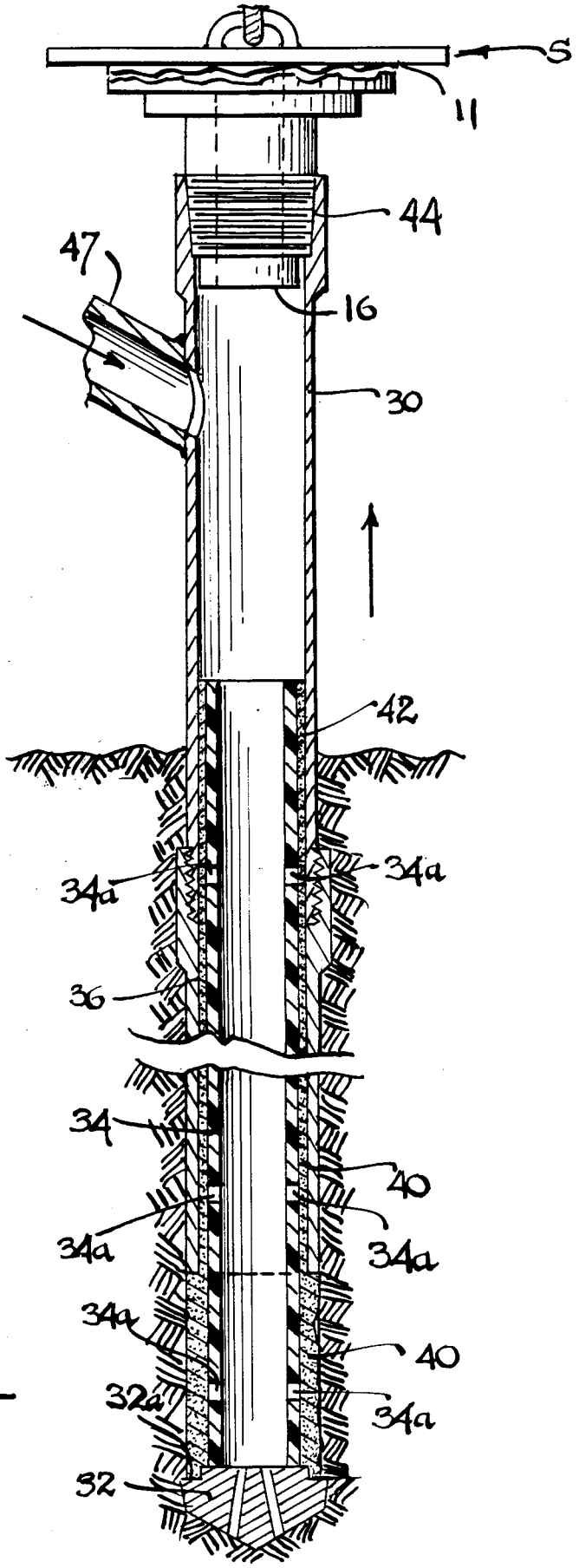
FIG. 3A is an elevational view in cross section of the third embodiment showing the metallic casing in the process of being removed from the well.

In certain installations, it is desirable to seal off the top of the sand annulus with a layer of cement 42, the compaction of this cement being aided by momentary activation of oscillator 11. When these operations have been completed, casing 30 is again driven by means of oscillator 11 at a frequency such as to set up resonant standing wave vibration of casing 30 while the casing is being lifted upwardly as shown in FIG. 3A. As for the previous embodiments, casing 30 is thus lifted out of the well leaving casing 34, sand annulus 40 and cement annulus 42 in place. The sonic activation of the casing during such extraction frees up sand body 40 and cement body 42 for intimate contact with the surrounding earth, the sonically fluidized sand and cement under the force of sidewise gravity flow filling the annular gap left with the removal of casing 30. The casing of course must be extracted before cement body 42 has set.

Figure 4A:
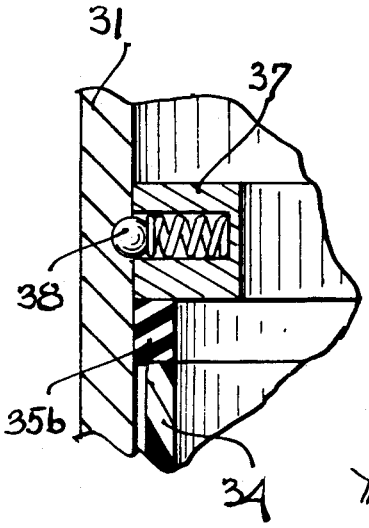
FIG. 4A is a cut away cross sectional view of the fourth embodiment illustrating a mechanism for longitudinally retaining the inner casing thereof.
Figure 4:
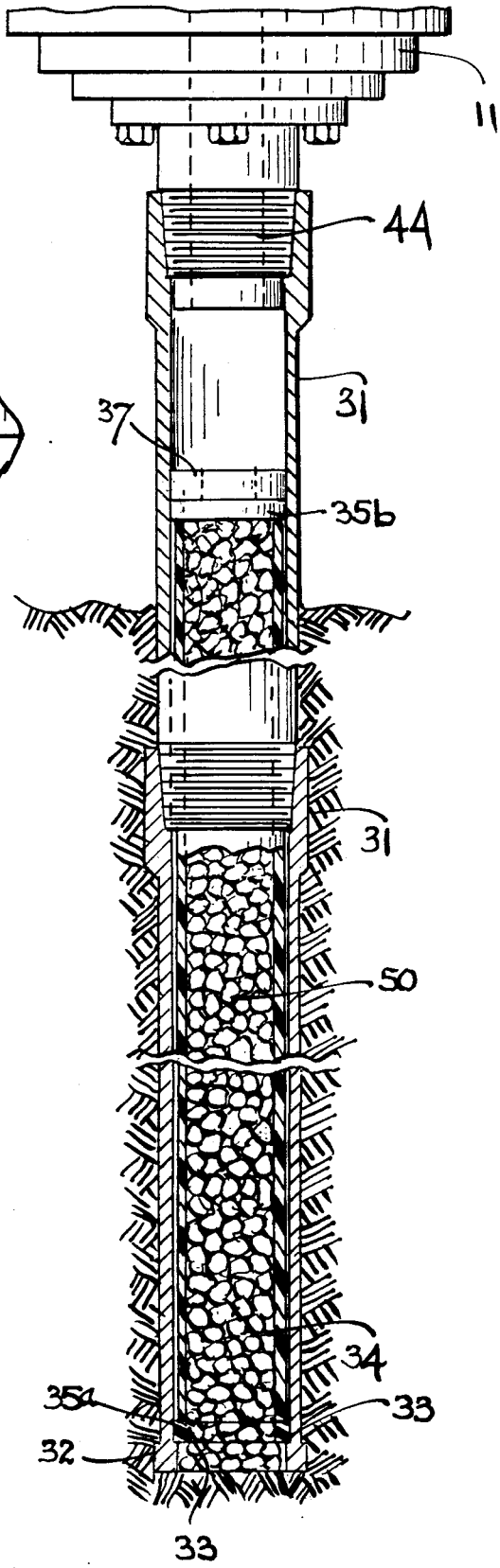
FIG. 4 is an elevational view in cross section of a fourth embodiment of the invention.

Referring now to FIGS. 4 and 4A, further embodiment of the invention is illustrated. This embodiment is particularly directed to the taking of earthen core samples both in monitor well work as well as geologic prospecting and the like. As for the previous embodiment metal outer casing 30 is attached to oscillator 11 by means of threaded coupler 44. A circular coring bit 32 is attached to the bottom end of casitn 31. Inner casing 34 which is fabricated of a material such as an inert plastic is contained within casing 31 in concentric relationship therewith and forms a core barrel, this core barrel being loose within casing 31. Inner casing 34 is retained in pace in casing 31 between resilient ring member 35*a* which is installed directly above bit 32 against shoulder 33 and resilient ring member 35*b* which is directly below retainer ring member 37 installed within casing 31. As shown in FIG. 4A, retainer ring 37 operates in conjunction with a plurality of spring urged detent ball members 38 which snap into sockets formed in the inner wall of casing 31.

As for the previous embodiment, casing 31 is sonically driven in a resonant standing wave mode of vibration by means of oscillator 11 such that it penetrates into the ground. A core sample 50 is driven up within inner casing 34. After the penetration has been completed (as shown in FIG. 4) inner casing 34 with the core sample contained therein is pulled out of outer casing 31 by means of a conventional wire line retriever that simultaneously releases and extracts retaining ring 37. If so desired, inner casing 34 may be extracted along with outer casing 31.

A significant feature of this embodiment of the invention is that inner casing member 34 is sonically isolated from the driven outer casing member 31 so that the core material 50 is not significantly changed by the sonic energy which might change its characteristics such as to make the evaluation thereof inaccurate. This end result is achieved by installing inner casing 34 in a loose fit within outer casing 31 and by providing compliant isolator ring members 35*a* and 35*b* at the opposite ends of the inner casing.

While the invention has been described and illustrated in detail, it is to be clearly understood that this is intended by way of illustration and example only and is not to be taken by way of limitation, the spirit and scope of the invention being limited only by the terms of the followings claims.

I claim:

1. A system for installing monitor wells in the earth for sampling the earthen material therein comprising:

a first elongated casing of an elastic material, said casing having top and bottom ends and an inner surface, a second elongated casing in concentric relationship to said first casing, and loosely held to said first casing, a sonic oscillator coupled to the top end of said first casing, said oscillator having a bottom end, and a driving end piece removably attached to the bottom end of said first casing and not attached to said second casing, said driving end piece having a top, said second casing being retained between the top of said driving end piece and the bottom end of said oscillator, said oscillator being operated at a frequency such as to effect resonant standing wave vibration of said first casing thereby to drive said casings into the ground and when said casings have been driven to the desired depth said oscillator being operated to vibrate said first casing to facilitate the removal thereof from the earth while said second casing and said driving end piece are left in place in the ground.

2. The system of claim 1 wherein said first casing has thin walled extension means at its bottom end for facilitating the entry of an earthen core into said first casing.

3. The system of claim 1 wherein said end piece is a circular coring bit for facilitating the coring of an earthen sample which enters into said second casing.

4. A method for installing monitor wells in the ground comprising the steps of:

loosely fitting a first casing into a second casing in concentric relationship therewith, loosely fitting a driving end piece on one end of one of said casings, attaching a sonic oscillator to the other end of said one of said casings, placing said driving end piece on the ground, operating said oscillator at a frequency such as to effect resonant standing wave vibration of said one of said casings thereby driving both of said casings into the ground, and when said casings have penetrated into the ground to a predetermined depth, pulling upwardly on said one of said casings while continuing to operate said oscillator to remove said one of said casings from the ground, leaving the other of said casings and said end piece in place in the ground.

5. The method of claim 4 and additionally including the feeding of water through said casings to the ground to facilitate the penetration thereof.

6. The method of claim 4 wherein said one of said casings is of an elastic metal and the other of said casings is of an inert plastic.

7. The method of claim 4 wherein said driving end piece is a circular coring bit, a core sample of earthen material entering said other of said casings, both of said casings being removed from the ground.

8. The method of claim 4 wherein said driving end piece is a circular coring bit, a core sample of earthen material entering said other of said casings, said other of said casings being removed from the ground, said one of said casings and said end piece being left in the ground.

9. A system for installing monitor wells in the earth for sampling the earthen material therein comprising:

a first elongated casing of an elastic metal material, said casing having top and bottom ends and an inner surface, a second elongated casing of an inert plastic in internal concentric relationship to said first casing, and loosely held to said first casing, a sonic oscillator coupled to the top end of said first casing, said oscillator having a bottom end, and a driving end piece removably attached to the bottom end of said first casing and not attached to said second casing, said oscillator being operated at a frequency such as to effect resonant standing wave vibration of said first casing thereby to drive said casings into the ground and when said casings have been driven to the desired depth said oscillator being operated to vibrate said first casing to facilitate the removal thereof from the earth while said second casing and said driving end piece are left in place in the ground.

10. The system of claim 9 wherein said second casing is loosely fitted within said first casing and further including resilient means for longitudinally supporting said second casing at the opposite ends thereof to provide vibrational isolation from said first casing.

11. A system for installing monitor wells in the earth for sampling the earthen material therein comprising:

a first elongated casing of an elastic metal material, said casing having top and bottom ends and an inner surface, a second elongated casing of an inert plastic in concentric relationship to said first casing, and loosely held to said first casing, a sonic oscillator coupled to the top end of said first casing, said oscillator having a bottom end, and a driving end piece removably attached to the bottom end of said first casing and not attached to said second casing, said driving end piece comprising a cap member loosely fitted onto said first casing, said oscillator being operated at a frequency such as to effect resonant standing wave vibration of said first casing thereby to drive said casings into the ground and when said casings have been driven to the desired depth said oscillator being operated to vibrate said first casing to facilitate the removal thereof from the earth while said second casing and said driving end piece are left in place in the ground.

* * * * *